US005975334A

United States Patent [19]

Mayo

[11] Patent Number: 5,975,334

[45] Date of Patent: Nov. 2, 1999

[54] PICNIC COOLER

[76] Inventor: Gregory S. Mayo, 5591 Grove Rd., Trumansburg, N.Y. 14886

[21] Appl. No.: 09/168,467

[22] Filed: Oct. 8, 1998

[51] Int. Cl.[6] ..... B65D 25/04

[52] U.S. Cl. ..... 220/592.03; 220/592.2; 220/574.1; 220/4.27; 220/915.1

[58] Field of Search ..... 220/915.1, 915.2, 220/574.1, 592.03, 592.2, 4.27, 4.23, 531, 507, 555, 62.13, DIG. 10, 760, 762, 774

[56] References Cited

U.S. PATENT DOCUMENTS

| | | | |
|---|---|---|---|
| 421,199 | 2/1890 | Slaughter . | |
| 2,496,296 | 2/1950 | Lobl . | |
| 2,555,788 | 6/1951 | Donaldson . | |
| 3,791,547 | 2/1974 | Branscum | 220/408 |
| 4,499,998 | 2/1985 | Carlson | 206/541 |
| 4,848,585 | 7/1989 | Snyder | 206/566 |
| 4,917,256 | 4/1990 | Kruck et al. | 220/4.28 |

*Primary Examiner*—Stephen Castellano

[57] ABSTRACT

A new picnic cooler for carrying eating utensils along with edibles. The inventive device includes a base and a perimeter wall upwardly extending around the base. A tray is rested on the top edge of the perimeter wall. The back edge of the tray is hingedly coupled to the back wall of the perimeter wall. A lid is hingedly coupled to the back wall of the perimeter wall at the top edge of the perimeter wall. A handle is pivotally coupled to the side walls of the perimeter side wall. The upper face of the tray has a plurality of depressions forming compartments in the upper face of the tray.

10 Claims, 3 Drawing Sheets

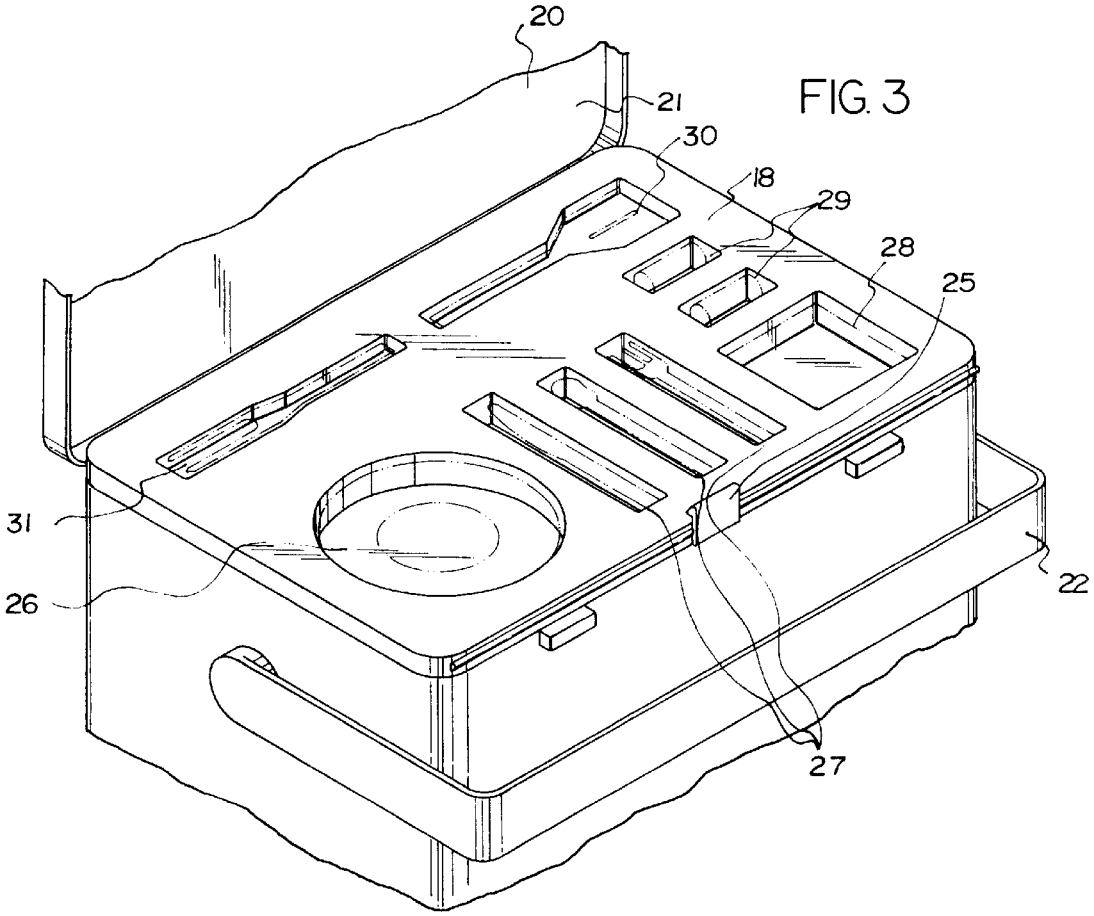
FIG. 3
FIG. 4
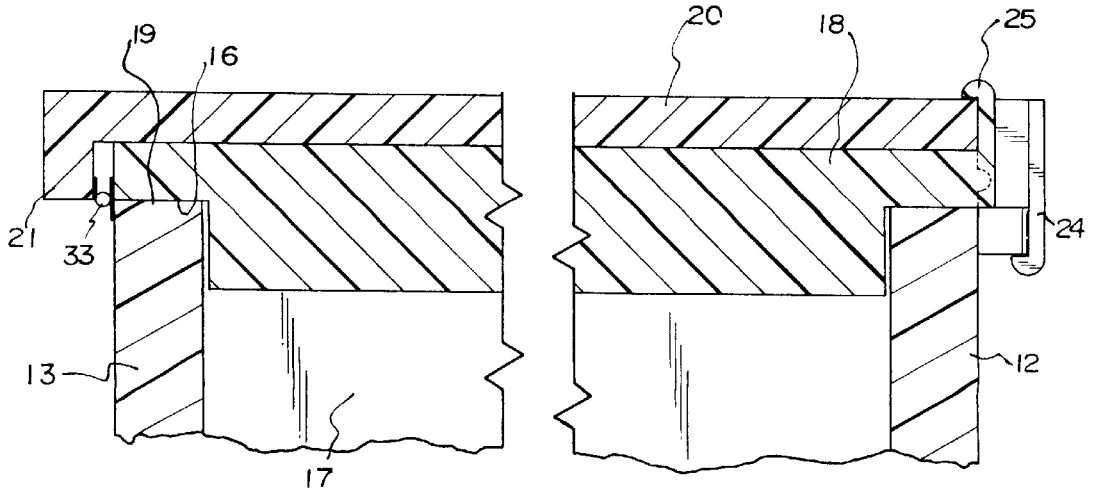

PICNIC COOLER

BACKGROUND OF THE INVENTION

1. Field of the Invention

The present invention relates to picnic coolers and more particularly pertains to a new picnic cooler for carrying eating utensils along with edibles.

2. Description of the Prior Art

The use of picnic coolers is known in the prior art. More specifically, picnic coolers heretofore devised and utilized are known to consist basically of familiar, expected and obvious structural configurations, notwithstanding the myriad of designs encompassed by the crowded prior art which have been developed for the fulfillment of countless objectives and requirements.

Known prior art picnic coolers include U.S. Pat. No. 5,174,452; U.S. Pat. No. 5,090,572; U.S. Pat. No. Des. 335,960; U.S. Pat. No. 4,143,695; U.S. Pat. No. 3,015,429; and U.S. Pat. No. 2,857,949.

While these devices fulfill their respective, particular objectives and requirements, the aforementioned patents do not disclose a new picnic cooler. The inventive device includes a base and a perimeter wall upwardly extending around the base. A tray is rested on the top edge of the perimeter wall. The back edge of the tray is hingedly coupled to the back wall of the perimeter wall. A lid is hingedly coupled to the back wall of the perimeter wall at the top edge of the perimeter wall. A handle is pivotally coupled to the side walls of the perimeter side wall. The upper face of the tray has a plurality of depressions forming compartments in the upper face of the tray.

In these respects, the picnic cooler according to the present invention substantially departs from the conventional concepts and designs of the prior art, and in so doing provides an apparatus primarily developed for the purpose of carrying eating utensils along with edibles.

SUMMARY OF THE INVENTION

In view of the foregoing disadvantages inherent in the known types of picnic coolers now present in the prior art, the present invention provides a new picnic cooler construction wherein the same can be utilized for carrying eating utensils along with edibles.

The general purpose of the present invention, which will be described subsequently in greater detail, is to provide a new picnic cooler apparatus and method which has many of the advantages of the picnic coolers mentioned heretofore and many novel features that result in a new picnic cooler which is not anticipated, rendered obvious, suggested, or even implied by any of the prior art picnic coolers, either alone or in any combination thereof.

To attain this, the present invention generally comprises a base and a perimeter wall upwardly extending around the base. A tray is rested on the top edge of the perimeter wall. The back edge of the tray is hingedly coupled to the back wall of the perimeter wall. A lid is hingedly coupled to the back wall of the perimeter wall at the top edge of the perimeter wall. A handle is pivotally coupled to the side walls of the perimeter side wall. The upper face of the tray has a plurality of depressions forming compartments in the upper face of the tray.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new picnic cooler apparatus and method which has many of the advantages of the picnic coolers mentioned heretofore and many novel features that result in a new picnic cooler which is not anticipated, rendered obvious, suggested, or even implied by any of the prior art picnic coolers, either alone or in any combination thereof.

It is another object of the present invention to provide a new picnic cooler which may be easily and efficiently manufactured and marketed.

It is a further object of the present invention to provide a new picnic cooler which is of a durable and reliable construction.

An even further object of the present invention is to provide a new picnic cooler which is susceptible of a low cost of manufacture with regard to both materials and labor, and which accordingly is then susceptible of low prices of sale to the consuming public, thereby making such picnic cooler economically available to the buying public.

Still yet another object of the present invention is to provide a new picnic cooler which provides in the apparatuses and methods of the prior art some of the advantages thereof, while simultaneously overcoming some of the disadvantages normally associated therewith.

Still another object of the present invention is to provide a new picnic cooler for carrying eating utensils along with edibles.

Yet another object of the present invention is to provide a new picnic cooler which includes a base and a perimeter wall upwardly extending around the base. A tray is rested on the top edge of the perimeter wall. The back edge of the tray is hingedly coupled to the back wall of the perimeter wall. A lid is hingedly coupled to the back wall of the perimeter wall at the top edge of the perimeter wall. A handle is pivotally coupled to the side walls of the perimeter side wall. The upper face of the tray has a plurality of depressions forming compartments in the upper face of the tray.

Still yet another object of the present invention is to provide a new picnic cooler that allows a user to carry virtually everything needed for a picnic in a single carrying container Even still another object of the present invention is to provide a new picnic cooler that keeps all the utensils organized in their own compartments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the upper face of the tray of the present invention.

FIG. 4 is a schematic sectional view of the present invention taken from line 4—4 of FIG. 1.

DESCRIPTION OF THE PREFERRED EMBODIMENT

Figure 1:
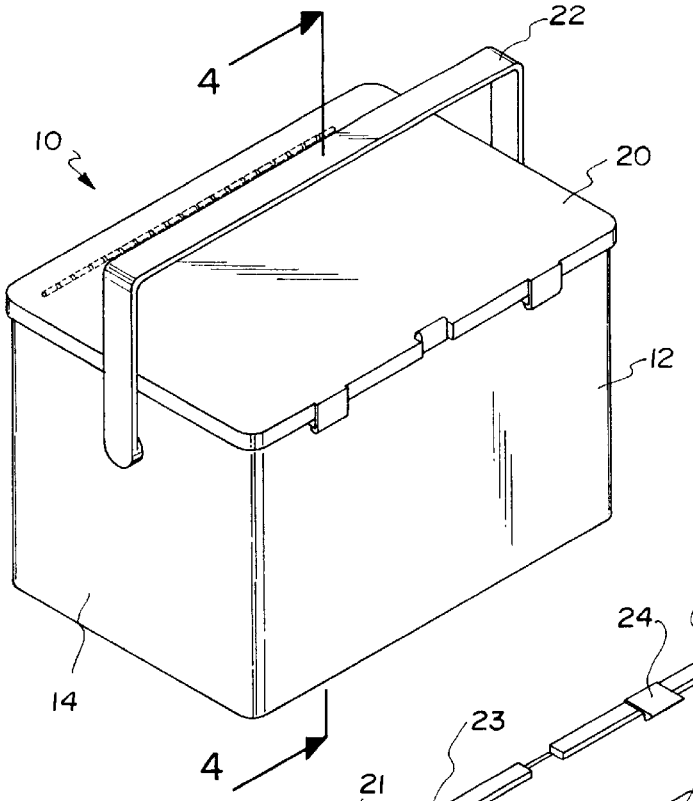
FIG. 1 is a schematic perspective view of a new picnic cooler with the lid closed according to the present invention.
Figure 2:
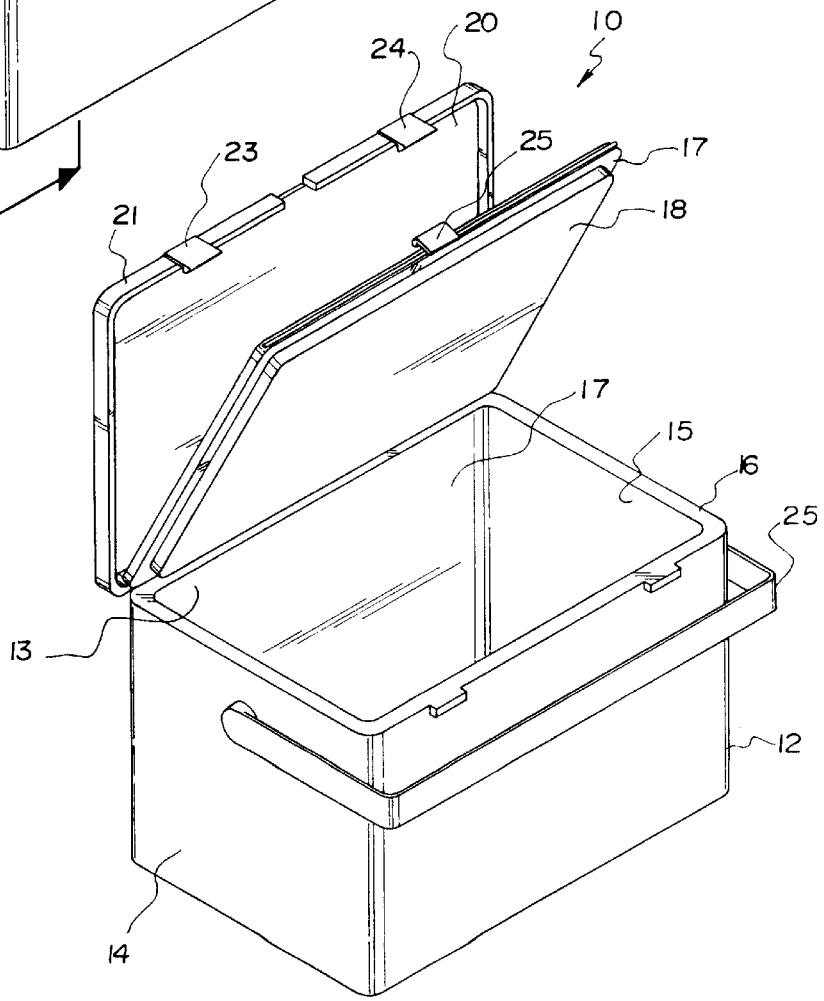
FIG. 2 is a schematic perspective view of the present invention with the lid open.

With reference now to the drawings, and in particular to FIGS. 1 through 5 thereof, a new picnic cooler embodying the principles and concepts of the present invention and generally designated by the reference numeral 10 will be described.

As best illustrated in FIGS. 1 through 5, the picnic cooler 10 generally comprises a lower container having a base and a perimeter wall upwardly extending around the base. A tray 18 is rested on the top edge 16 of the perimeter wall. The back edge of the tray 18 is hingedly coupled 33 to the back wall 13 of the perimeter wall. A lid 20 is hingedly coupled 33 to the back wall 13 of the perimeter wall at the top edge 16 of the perimeter wall. A handle 22 is pivotally coupled to the side walls 14,15 of the perimeter side wall. The upper face of the tray 18 has a plurality of depressions forming compartments 26,27,28,29,30,31 in the upper face of the tray 18.

In closer detail, the cooler container 10 includes a lower container having a generally rectangular base and a perimeter wall upwardly extending around the base. The perimeter wall has a top edge 16 and includes front and back walls 12,13 and a pair of side walls 14,15 extending between the front and back walls 12,13. The front, back, and side walls 14,15 are preferably generally rectangular. The base and the perimeter wall define a container interior space 17 designed for holding items such as food stuffs therein. The top edge 16 of the perimeter side wall defines an generally rectangular upper opening into the container interior space 17.

The cooler container also includes generally rectangular tray 18 having a perimeter edge, and upper and lower faces. The perimeter edge of the tray 18 includes front and back edges. The perimeter edge of the tray 18 also forms an annular shoulder 19 around the outer perimeter of the lower face of the tray 18 such that the outer perimeter of the upper face of the tray 18 extends around the outer perimeter of the lower face of the tray 18. The annular shoulder 19 of the tray 18 is rested on the top edge 16 of the perimeter wall such that the lower face of the tray 18 substantially covers the upper opening into the container interior space 17. The back edge of the tray 18 is hingedly coupled 33 to the back wall 13 of the perimeter wall at the top edge 16 of the perimeter wall.

A lid 20 is also provided. The lid 20 is generally rectangular and has a front, a back, and perimeter lip 21 downwardly extending therearound. The lid 20 substantially covers the upper face of the tray 18 and the upper opening into the interior space 17 with the lip 21 extending around the top edge 16 of the perimeter wall and the perimeter edge of the tray 18. The back of the lid 20 is hingedly coupled 33 to the back wall 13 of the perimeter wall at the top edge 16 of the perimeter wall.

The cooler 10 preferably includes a handle 22 having a pair of arms and a cross bar connecting the arms. One of the arms of the handle 22 is pivotally coupled to one of the side walls 14 of the perimeter side wall while the other arm of the handle is pivotally coupled to the other side wall 15 of the perimeter side wall.

A pair of latches 23,24 releasably attach the front of the lid 20 to the front wall 12 of the perimeter side wall. The pair of latches 23,24 are preferably coupled to the front of the lid 20 and engage a pair of tabs on the front wall 12 of the perimeter wall to hold the lid to the perimeter wall. A tray latch 25 releasably attaches the front edge of the tray 18 to the front of the lid 18. The tray latch 25 is preferably positioned between the latches of the pair of latches 23,24. Preferably, the tray latch 25 is coupled to the front edge of the tray 18 and engages the lid 20 at a notch in the front of the tray 18.

As illustrated in FIG. 3, the upper face of, the tray 18 has a plurality of depressions forming compartments 26,27,28, 29,30,31 in the upper face of the tray 18. The compartments include a generally circular plate compartment 26 adapted for receiving plates therein. The compartments also preferably include a number of generally rectangular utensil compartments 27 adapted for receiving eating utensils therein. A generally rectangular napkin compartment 28 adapted for receiving napkins therein is also included. Preferably, the compartments include a pair of generally rectangular shaker compartments 29 adapted for receiving condiment shakers therein. In the preferred embodiment, the compartments also include a spatula compartment 30 and a cooking fork compartment 31 adapted for receiving therein a spatula and a cooking fork respectfully.

Figure 5:
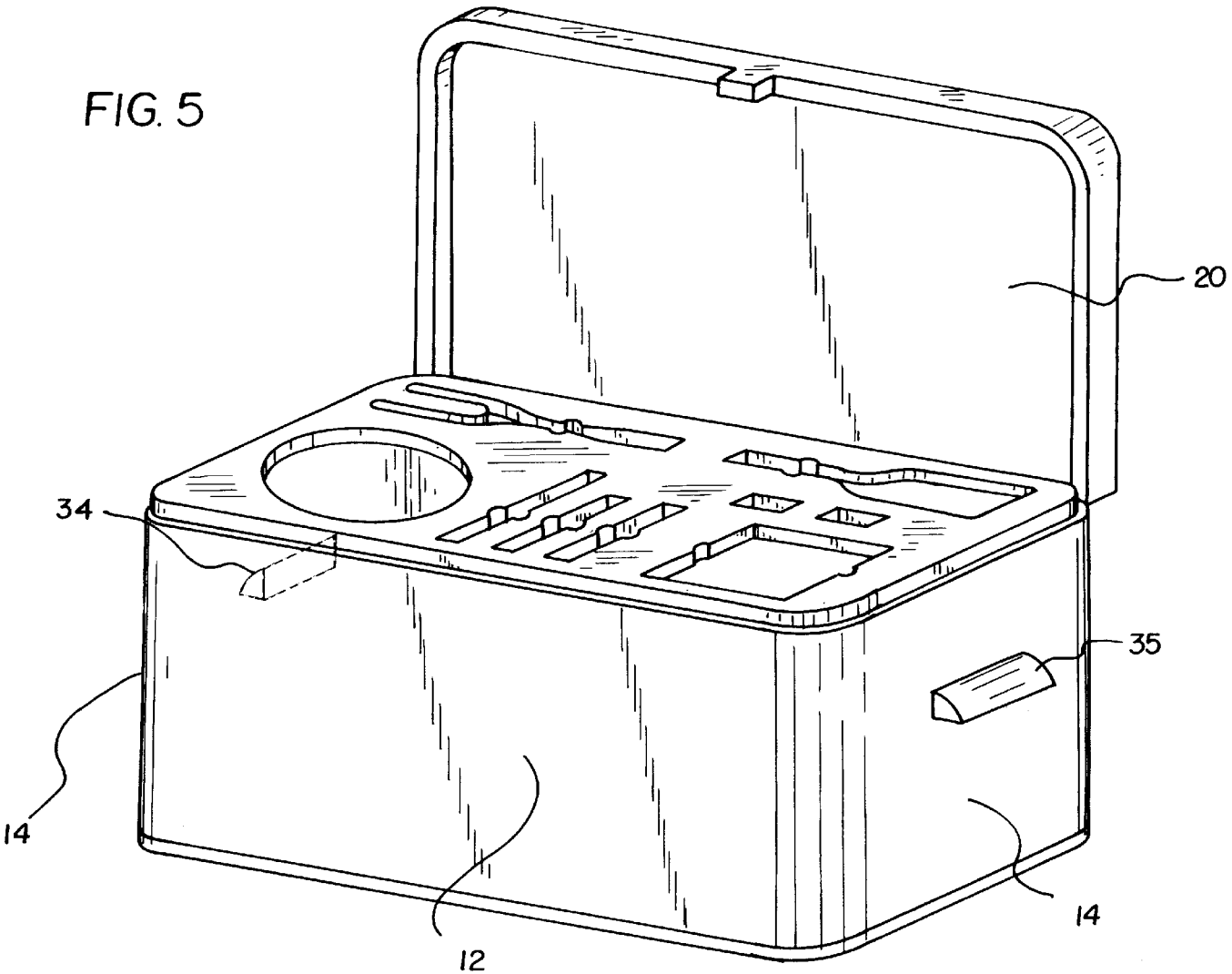
FIG. 5 is a schematic side view of a preferred embodiment of the present invention having a pair of side finger handles.

Preferably, as illustrated in FIG. 5, the cooler has a pair of side finger handles 34,35 instead of a single large handle 22. These side finger handles 34,35 are coupled to the side walls 14,15 of the cooler.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooler container, comprising:

a base;

a perimeter wall being upwardly extended around said base, said perimeter wall having a top edge, said perimeter wall including front and back walls and a pair of side walls extending between said front and back walls of said perimeter wall;

said base and said perimeter wall defining a container interior space;

said top edge of said perimeter side wall defining an upper opening into said container interior space;

a tray having a perimeter edge, and upper and lower faces;

said perimeter edge of said tray including front and back edges, said perimeter edge of said tray forming an annular shoulder around the outer perimeter of said lower face of said tray;

said annular shoulder of said tray being rested on said top edge of said perimeter wall such that said lower face of said tray substantially covers said upper opening into said container interior space;

said back edge of said tray being hingedly coupled to said back wall of said perimeter wall at said top edge of said perimeter wall;

a lid having a front, a back, and perimeter lip downwardly extending therearound, said lid substantially covering said upper face of said tray and said upper opening into said interior space, said lip being extended around said top edge of said perimeter wall and said perimeter edge of said tray;

said back of said lid being hingedly coupled to said back wall of said perimeter wall at said top edge of said perimeter wall;

a handle having a pair of arms and a cross bar connecting said arms, one of said arms of said handle being pivotally coupled to one of said side walls of said perimeter side wall, another of said arms of said handle being pivotally coupled to another of said side walls of said perimeter side wall; and said upper face of said tray having a plurality of depressions forming compartments in said upper face of said tray.

2. The cooler container of claim 1, further comprising a pair of latches releasably coupling said front of said lid to said front wall of said perimeter side wall.

3. The cooler container of claim 1, further comprising a tray latch releasably coupling said front edge of said tray to said front of said lid.

4. The cooler container of claim 1, wherein said compartments include a generally circular plate compartment adapted for receiving plates therein.

5. The cooler container of claim 1, wherein said compartments include a number of generally rectangular utensil compartments adapted for receiving eating utensils therein.

6. The cooler container of claim 1, wherein said compartments include a generally rectangular napkin compartment adapted for receiving napkins therein.

7. The cooler container of claim 1, wherein said compartments include a pair of generally rectangular shaker compartments adapted for receiving condiment shakers therein.

8. The cooler container of claim 1, wherein said compartments include a spatula compartment adapted for receiving a spatula therein.

9. The cooler container of claim 1, wherein said compartments include a cooking fork compartment adapted for receiving a cooking fork therein.

10. A cooler container, comprising:

a base being generally rectangular;

a perimeter wall being upwardly extended around said base, said perimeter wall having a top edge, said perimeter wall including front and back walls and a pair of side walls extending between said front and back walls of said perimeter wall, said front, back, and side walls being generally rectangular;

said base and said perimeter wall defining a container interior space;

said top edge of said perimeter side wall defining an upper opening into said container interior space;

a tray being generally rectangular and having a perimeter edge, and upper and lower faces;

said perimeter edge of said tray including front and back edges, said perimeter edge of said tray forming an annular shoulder around the outer perimeter of said lower face of said tray;

said annular shoulder of said tray being rested on said top edge of said perimeter wall such that said lower face of said tray substantially covers said upper opening into said container interior space;

said back edge of said tray being hingedly coupled to said back wall of said perimeter wall at said top edge of said perimeter wall;

a lid being generally rectangular and having a front, a back, and perimeter lip downwardly extending therearound, said lid substantially covering said upper face of said tray and said upper opening into said interior space, said lip being extended around said top edge of said perimeter wall and said perimeter edge of said tray;

said back of said lid being hingedly coupled to said back wall of said perimeter wall at said top edge of said perimeter wall;

a handle having a pair of arms and a cross bar connecting said arms, one of said arms of said handle being pivotally coupled to one of said side walls of said perimeter side wall, another of said arms of said handle being pivotally coupled to another of said side walls of said perimeter side wall;

a pair of latches releasably coupling said front of said lid to said front wall of said perimeter side wall;

a tray latch releasably coupling said front edge of said tray to said front of said lid, said tray latch being positioned between said latches of said pair of latches;

said upper face of said tray having a plurality of depressions forming compartments in said upper face of said tray;

said compartments including a generally circular plate compartment adapted for receiving plates therein;

said compartments including a number of generally rectangular utensil compartments adapted for receiving eating utensils therein;

said compartments including a generally rectangular napkin compartment adapted for receiving napkins therein;

said compartments including a pair of generally rectangular shaker compartments adapted for receiving condiment shakers therein;

said compartments including a spatula compartment adapted for receiving a spatula therein; and said compartments including a cooking fork compartment adapted for receiving a cooking fork therein.

* * * * *